US006122841A

United States Patent [19]

Jensen

[11] Patent Number: 6,122,841

[45] Date of Patent: Sep. 26, 2000

[54] APPARATUS FOR THE DRYING OF MOIST PARTICULATE MATERIAL IN SUPERHEATED STEAM

[75] Inventor: Arne Sloth Jensen, Lyngby, Denmark

[73] Assignee: ASJ Holding ApS, Lyngby, Denmark

[21] Appl. No.: 09/187,871

[22] Filed: Nov. 6, 1998

[30] Foreign Application Priority Data

May 7, 1998 [DK] Denmark ..... 1998 00624

[51] Int. Cl.[7] ..... F26B 13/10

[52] U.S. Cl. ..... 34/560; 34/588; 34/167; 34/169; 34/174

[58] Field of Search ..... 34/524, 560, 576, 34/588, 589, 86, 166, 167, 168, 169, 171, 174, 177, 181, 187

[56] References Cited

U.S. PATENT DOCUMENTS

| | | | |
|---|---|---|---|
| 4,247,302 | 1/1981 | Woldy et al. | 48/197 R |
| 4,347,670 | 9/1982 | Wear et al. | 34/167 X |
| 4,813,155 | 3/1989 | Jensen et al. . | |
| 5,289,643 | 3/1994 | Jensen . | |
| 5,357,686 | 10/1994 | Jensen . | |
| 5,470,544 | 11/1995 | Galloway | 422/213 |

OTHER PUBLICATIONS

"Pressurized Steam Drying of Beet Pulp" by Arne Sloth Jense, NIRO A/S Special print of article in International Sugar Journal, Nov. 1992.

*Primary Examiner*—Stephen Gravini

*Attorney, Agent, or Firm*—Nims, Howes, Collison, Hansen & Lackert

[57] ABSTRACT

Apparatus for the drying of particulate material in superheated steam in a closed vessel (1). The vessel consists of a number of upwardly open, elongated and substantially vertical processing cells (2) which are placed around a central part with a heat exchanger (3). The last of these processing cells (2) has a closed bottom and is the discharge cell (4), while the remainder (2) have bottoms (5) through which steam can permeate. The processing cells (2), which lie at the side of one another, stand in mutual connection through openings (11) at the lowermost ends of the cells, so that the particulate material which is dried by the superheated steam which is blown up from the heat exchanger (3) through the steam-permeable bottoms (5) can pass from one processing cell (2) to the next through said openings (11). The opening (11) or the openings (11) between the discharge cell (4) and the adjacent processing cell or cells (2) are provided with an arrangement (16, 17) which can regulate the amount of particulate material which passes through the opening or openings (11), so that a sufficiently long drying time can be achieved.

5 Claims, 5 Drawing Sheets

APPARATUS FOR THE DRYING OF MOIST PARTICULATE MATERIAL IN SUPERHEATED STEAM

Figure 1:
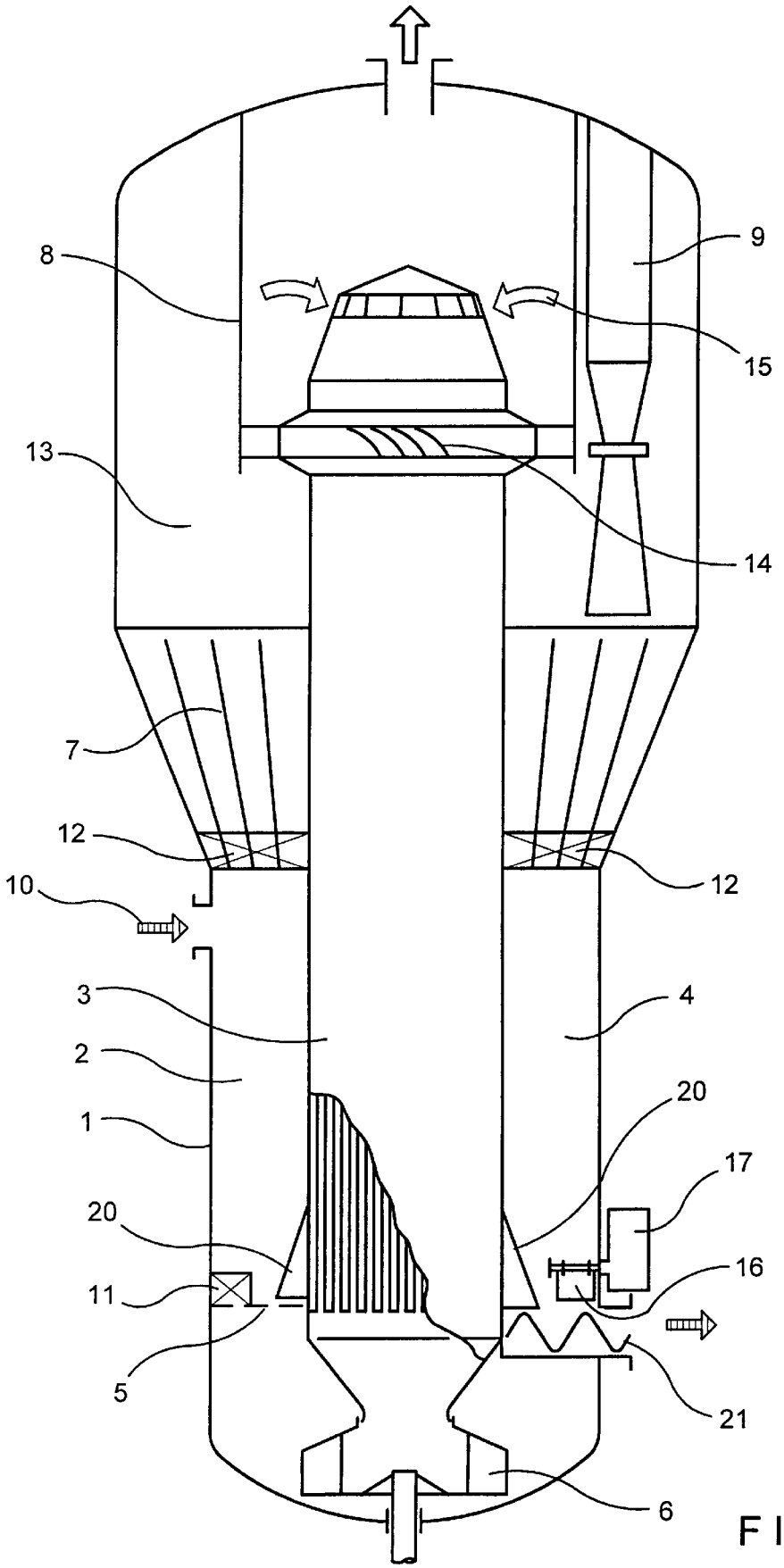

The invention concerns an apparatus for the drying of moist particulate material in superheated steam in a closed vessel which is configured like a body of rotation. The vessel has a lower cylindrical part which is connected via a conical transition piece to an upper cylindrical part with a greater diameter, The vessel has a central part in which there is a heat exchanger, under which there is disposed a transport element for steam, e.g. in the form of a blower such as a centrifugal blower. The vessel comprises a number of upwardly open, elongated and substantially vertical processing cells which are placed around the central part with the heat exchanger. The last of these processing cells has a closed bottom and is a discharge cell, while the remainder have a bottom through which steam can permeate. The processing cells, which lie at the side of one another, are open at the top opposite a common transfer zone, and at the bottom stand in mutual connection through openings at the lower ends of the cells. The particulate material is introduced into the first of the processing cells and is dried during its passage through the processing cells by the superheated steam, which by the transport element for steam from the heat exchanger is blown up through the steam-permeable bottoms, in that the particulate material can pass from one processing cell to the next through the above-mentioned openings.

The material to be dried is led into the first of the processing cells, where it is brought into a swirling movement by the steam which flows up through the cell's steam-permeable bottom. The heaviest particles pass from the one processing cell to the next through openings at the bottom. The lighter particles are blown up into the conical part which is similarly divided into cells. These are furthermore divided by inclined plates which form tapered cone surfaces. Opposite the lowermost parts of the cone surfaces there are openings between the processing cells to which the material is fed by guide rails placed on the cone surfaces. Above the cells there is a common zone where material is also fed forward towards the discharge cell. Unlike the remaining cells, no steam flows up through the bottom of the discharge cell. Therefore, all of the material which reaches forward to this cell falls down into the bottom, from which it is led away.

Apparatus of this type is known, for example from EP Patent Publication no. 153 704 (corresponding to U.S. Pat. No. 4,813,155), EP Patent Publication no. 537 262 (corresponding to U.S. Pat. No. 5,357,686) and EP Patent Publication no. 537 263 (corresponding to U.S. Pat. No. 5,289,643).

The use of the apparatus for the drying of sugar waste (pulp) is discussed in an article by Arne Sloth Jensen in International Sugar Journal, November 1992, Vol. 94, No. 1127. The dried beet pulp is normally used as cattle feed. The apparatus is especially applicable precisely within the sugar industry. Within this as well as other industries, the use of the apparatus enables the drying to take place without aeration of the product and without loading the environment, in that the drying is effected in a closed container, in this case under pressure. Consequently, nothing is discharged out into the atmosphere, unlike the conventional drum dryers which can be smelt approx. 20 km away. The water which is removed from the moist product leaves the drier as steam. This steam contains all of that energy which is used for the drying, and it can be used in the factory as process steam. A normal sugar factory hereby saves between 50 and 120 tons of fuel oil per day, or a corresponding amount of other fuel. Moreover, the process makes it possible for a sugar factory to keep the whole of the production running with Bio-fuel by burning the dried waste from the process, said waste in dried form containing more energy than the sugar factory is required to use. In such a case, an approximately three times greater amount of fuel is saved.

The known apparatus can also be used for the drying of wood chips or other moist fuels, whereby the overall energy yield is increased.

However, the known apparatus has proved unable to dry a product satisfactorily if the product involved is one which contains too many coarse particles which require a relatively long drying time. If a beet pulp is involved one can, in the cases where the percentage of coarse particles is not too great, solve the problem by over-drying the remaining particles so that the material on average attains the correct content of drystuffs. However, this can be done only by raising the temperature of the circulating steam, whereby a considerable part of the capacity of the apparatus (approx. 10%–40%) is lost. At the same time herewith, the quality of the product is reduced.

In those case where the percentage of coarse particles is particularly high, the situation can arise in which the product can simply not be dried to the drystuff content (approx. 90%) which is required in order for the finished product to be stored. In such cases the hitherto-known drying technology is unusable. Such a situation can arise, for example, if it is desired to dry beet pulp from beets which have been frozen.

The invention concerns an apparatus of the kind described in the introduction, and which is configured in such a way that it is able to dry particulate material containing particles of non-uniform size, in which material there are relatively many coarse particles or many particles which, due to the nature of the product, require a long drying time.

This is achieved when the apparatus is configured so that the opening or the openings between the discharge cell and the adjacent processing cell or cells are provided with an arrangement which can automatically regulate the amount of particulate material which passes through the opening or openings, in that the arrangement comprises a regulating element with which a closing of the opening or the openings can be controlled depending on one or more measured parameters. p It will hereby be possible for the heaviest particles to be retained in the apparatus for a length of time which is sufficient for these particles to be dried satisfactorily. These heavy particles will lie especially in the lowermost part of the processing cells, where they will pass through the openings in the cell walls immediately above the steam-permeable bottom. The opening from the last processing cells and to the discharge cell is provided with a regulating arrangement which can regulate the amount of that material which passes on the basis of the amount of product in the preceding cell. It is herewith possible to control the retention time for the heavy particles.

As disclosed in claim 2, by configuring the regulation arrangement so that it comprises a flap which can limit the size of the opening, a smaller risk of blockage is achieved, in that a blockage will result in an extra filling of that cell which lies immediately before the opening. The registration of this will result in a further opening of the automatically-regulated flap, and the blockage will be relieved.

Figure 2:
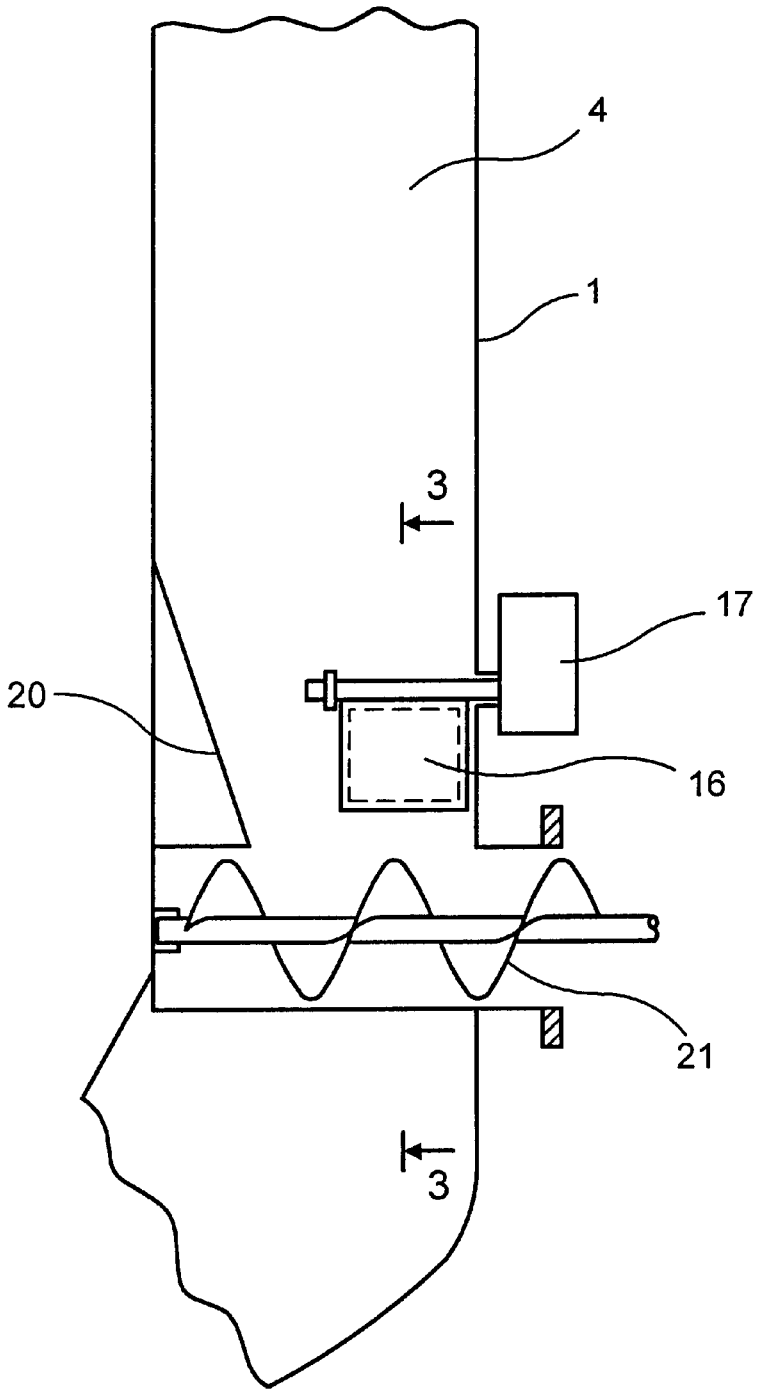
Figure 3:
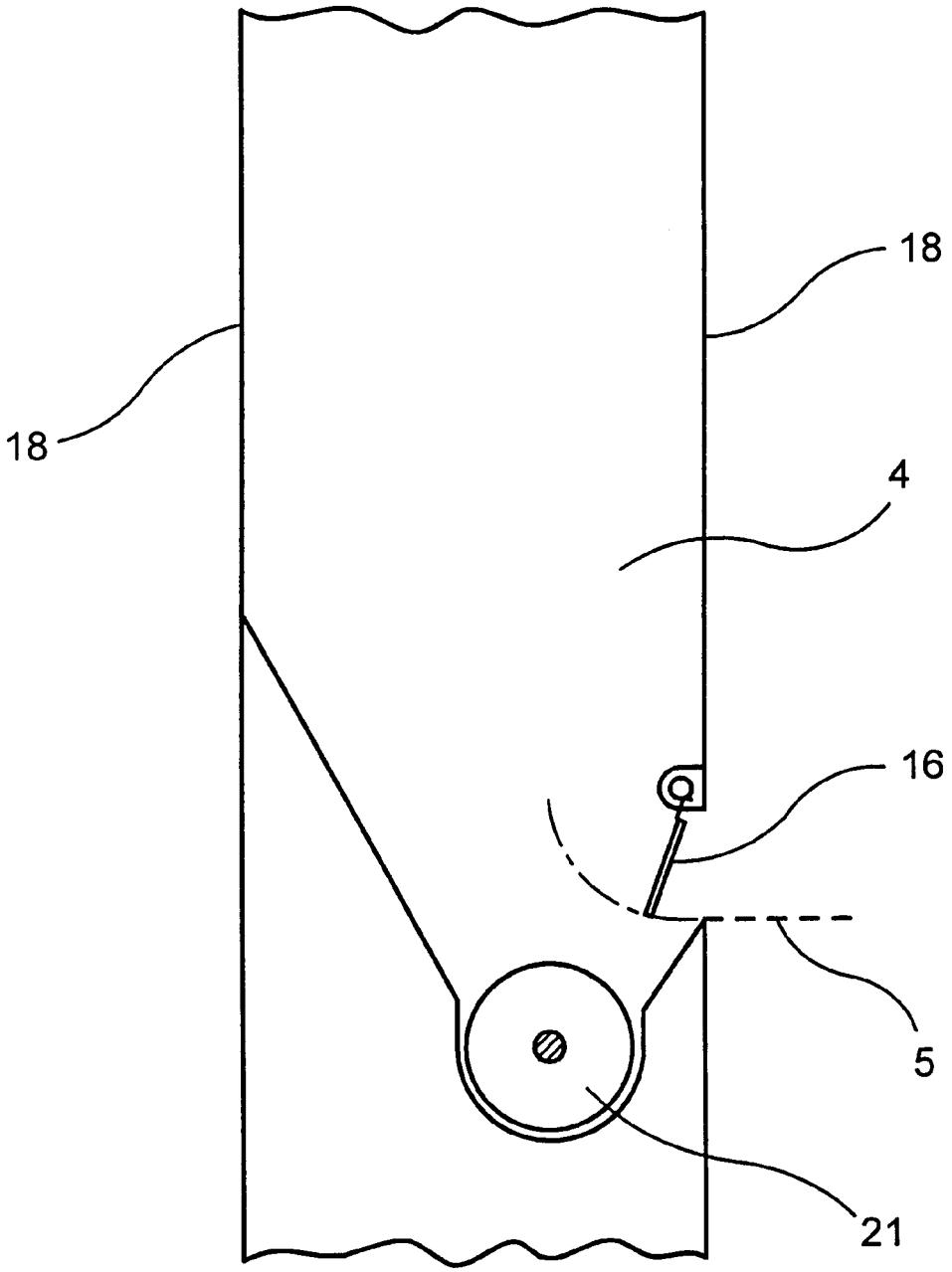
Figure 4:
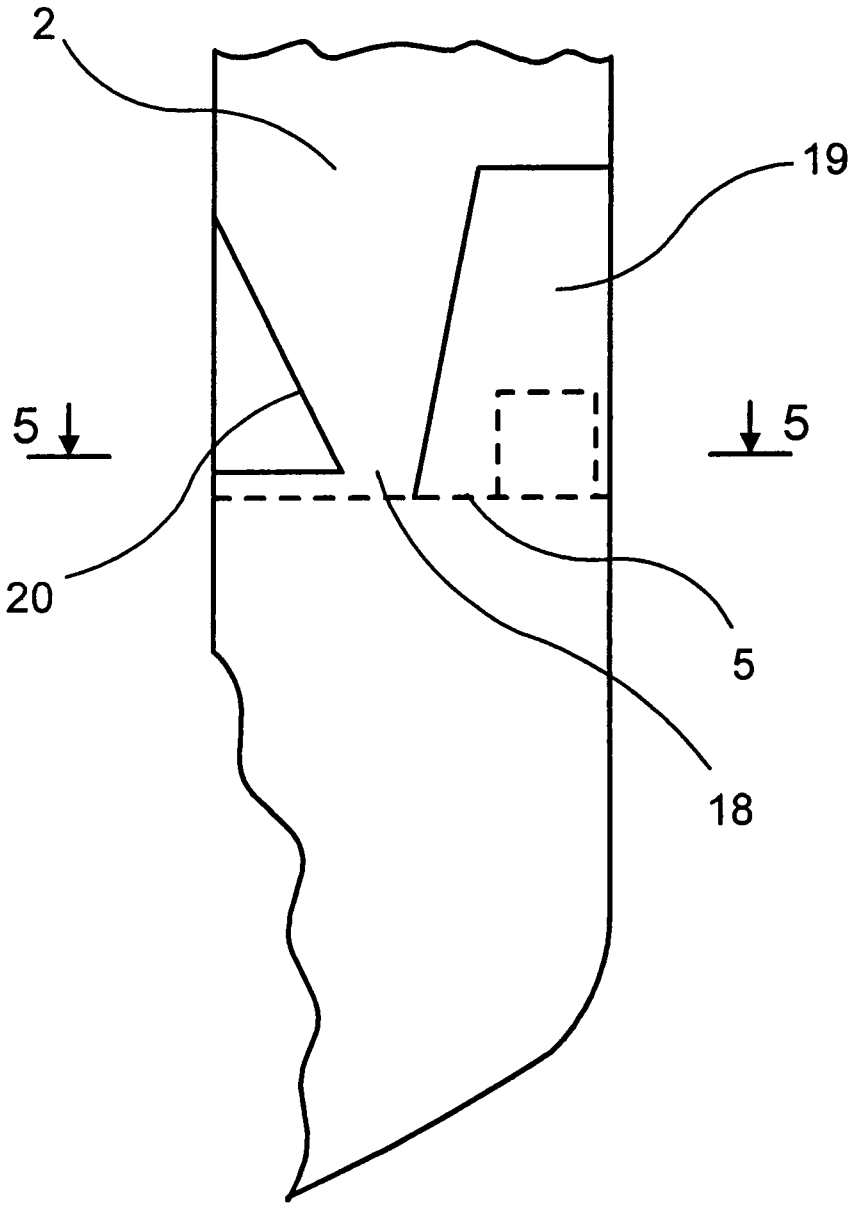
Figure 5:
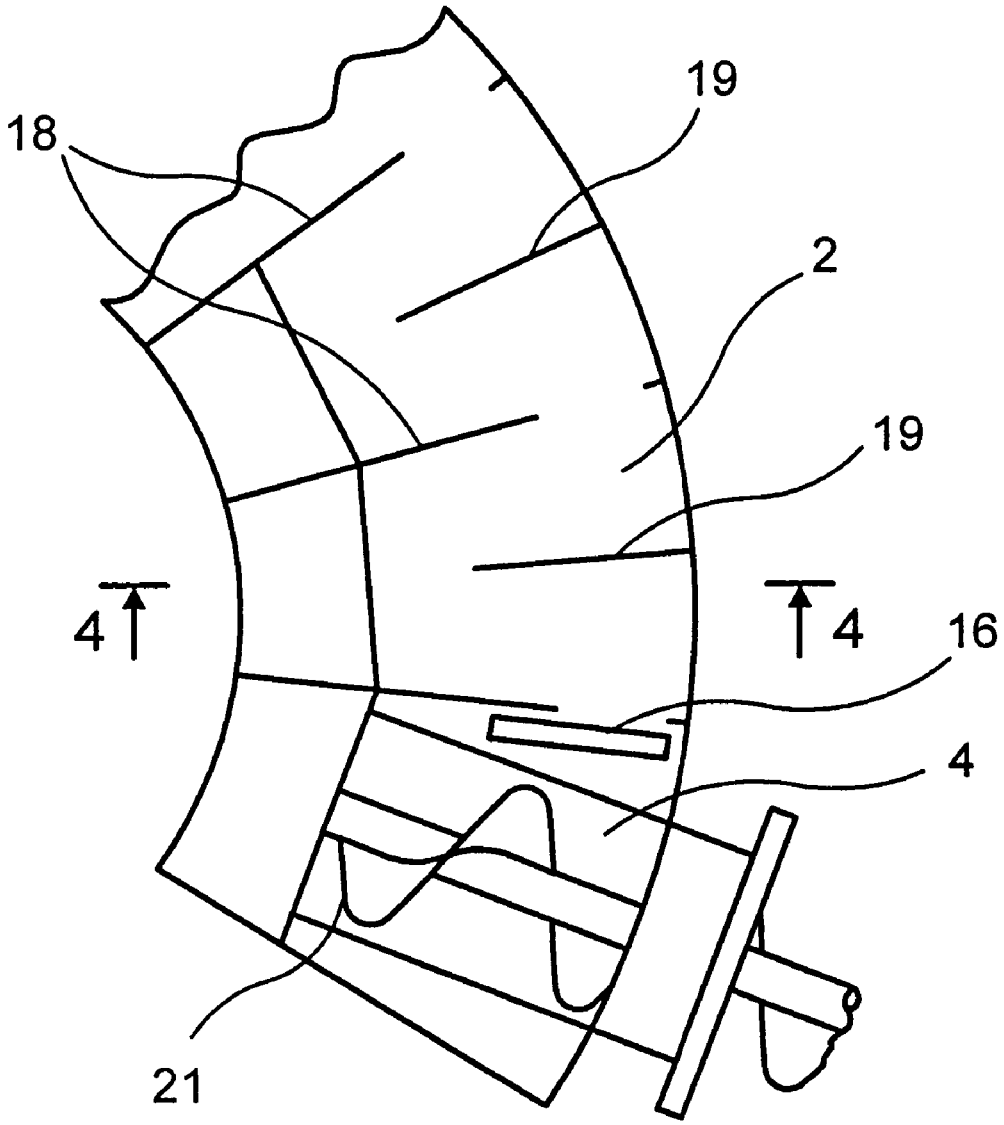

The invention will now be described in more detail with reference to the drawing, where FIG. 1 shows a vertical section of an apparatus according to the invention, FIG. 2 shows on a larger scale a vertical section through the lowermost part of the discharge cell in the apparatus shown in FIG. 1, FIG. 3 shows a section of the discharge cell along the line III—III in FIG. 2, FIG. 4 shows a vertical section through the lowermost part of a cell which is lying immediately before the discharge cell, such as shown by the line IV—IV in FIG. 5, and FIG. 5 shows a transverse section along the line V—V in FIG. 4 through the discharge cell and cells lying immediately before said discharge cell.

In FIG. 1 is shown a section of an apparatus for the drying of moist particulate material which can consist of particles of non-uniform size. The apparatus comprises a round container 1, which can be a pressure vessel. The vessel is provided lowermost with a cylindrical part which is closed at the bottom, and which via a conical transition piece extends into a similarly cylindrical part which is closed at the top. In the lowermost part and the conical transition piece there are a number of elongated, substantially vertical process zones which are also called cells or processing cells 2. These processing cells 2, of which there can for example be sixteen inside the vessel 1, are arranged around a heat exchanger 3 which lies in the centre of the vessel 1.

During the drying process, the particulate material is transported forward through the processing cells 2, in that the material is introduced into the first processing cell 2 and is removed from the last processing cell, which is also called the discharge cell 4. All of the processing cells 2, except for the discharge cell 4, have a bottom 5 through which steam can permeate, while the bottom in the discharge cell 4 is closed and is not steam-permeable. The drying of the particulate material is thus effected in all of the processing cells 2 with the exception of the discharge cell 4, in that the superheated steam will be conveyed up through the steam-permeable bottoms 5 up into the processing cells 2 by a blower in the form of a centrifugal blower placed under the heat exchanger 3. Here the steam will impart a swirling movement to the particulate material, whereby a drying of the particles is effected.

As mentioned, the vessel 1 is divided into cells in both the lowermost part and the conical transition part, while the uppermost part of the vessel constitutes a common zone 13 which is not divided into cells. In the cells 2 in the transition piece, conical plate pieces 7 are inserted which can be heated. These conical plate pieces serve not only to distribute the flows of steam through the cells 2 over to the common zone 13, but also to intercept entrained particles and lead these downwards again. In the upper part of the apparatus there is also a cyclone 8 at which the flow of steam arrives after passing a number of stationary guide vanes 14, which as shown in FIG. 1 are placed on an annular part on the heat exchanger 3. Finally, in the uppermost part of the apparatus there is a side cyclone 9 from which separated particles are led out to the discharge cell 4.

In the following, the function of the apparatus and its individual parts will be described in more detail.

The moist particulate material is fed continuously to the apparatus through an opening in the first processing cell 2, such as shown by the arrow 10. In the processing cells 2, the particulate product is brought into a swirling movement by the up-flowing superheated steam which is blown up through the steam-permeable bottoms 5 by a centrifugal blower 6. The swirling movement of the particulate material is supported by elements 20 which are triangular in section, said elements 20 being placed in the bottom of the processing cells in towards the centre of the apparatus. The circulating steam supplies heat to the particulate material, whereby water is evaporated. The particulate material passes through openings 11 in the bottom of the walls between the processing cells 2 from the one cell to the next, and the material can also pass from the one cell to the next through openings 12 in the cell walls, these openings 12 being provided at the lowermost part of the conical transition piece as shown in FIG. 1 Moreover, the particulate material can be transported by the steam up into the common zone 13, where it can pass further and fall down into a subsequent processing cell 2.

The steam will pass up and out through the cells at a speed at which particles, especially dust particles, are entrained, and which are separated by the cyclones 8 and 9. From the common zone 13, the steam will pass between the guide vanes 14 into the cyclone 8, in that the guide vanes 14 will create a cyclone field so that the particles entrained by the steam are separated and led over into the side cyclone 9, from which they are led directly down to the discharge cell 4.

As shown by the arrows 15, the greater part of the steam will pass through openings down in to the heat exchanger 3, which the steam flows down into under suction from the fan or the centrifugal blower 6 rotor. After having been re-heated in the heat exchanger, the steam will be returned to the processing cells 2. A smaller part of the steam, corresponding to the amount of water which is evaporated from the particulate material, will be led up from the cyclone 8 and out through an opening. This steam contains all of the energy which is used for drying, and it can be used, for example, as process steam, or the energy can be regained in other ways.

During the drying process in the apparatus, the heaviest of the particles will pass through the openings 11 in the cell walls at the bottom of the cells, and the heaviest of the dried particles will thus pass through the opening 11 in to the discharge cell 4. This opening is provided with a pivotable flap 16 which can be moved by a drive or regulation element 17, and is configured such as illustrated on a larger scale in FIGS. 2 and 3. The driving element 17, which is placed outside the vessel 1, can for example be a valve motor. As indicated in FIG. 3, the flap 16 can be set in various positions, so that the effective opening area of the opening 11 can be graduated between completely open and completely closed. By regulating the position of the flap, it can thus be achieved that a suitable amount of particulate material is lying in the last processing cells 2. It is hereby ensured that the flow of material forward to the discharge cell 4 does not take place too quickly, and it is thus ensured that all of the particles are given a sufficiently long drying time.

As an indicator for the amount of material, the temperature for the last cell or cells can be used, in that a large amount of material will result in greater cooling of the circulating steam and herewith a low temperature and vice versa. Similarly, a high content of moisture in the material will result in great cooling and herewith a low temperature. In cases of a large percentage of coarse and slowly-drying particles, for which a long retention time is necessary, precisely these particles will lie in the bottom of the cells, and the necessary retention time in the apparatus can be ensured by the correct automatic setting of the flap 16.

In addition to the placing of a flap 16 with associated driving element 17 between the discharge cell 4 and the adjacent processing cell 2, there can also be placed a corresponding closing arrangement with flap 16 and driving element 17 in the openings 11 between the last processing cells, especially between the processing cell which lies up to the discharge cell and that processing cell which lies immediately in front of this. It is hereby possible to establish an even longer drying time.

As shown in FIGS. 1, 2 and 3, in the discharge cell 4 there is placed a worm conveyor 21 which leads the dried particulate material out of the apparatus.

In connection with the closing arrangement with flap 16 and driving element 17, the ability of the apparatus to dry materials with a large percentage of particles requiring long drying time can be improved such as shown in FIGS. 4 and 5, i.e. by extending the cell wall 18 between the last cells right down to the steam-permeable bottom 5, instead of having a short distance down to the bottom 5, as is otherwise the case with the cell walls 18. In order to avoid an accumulation of material in the transition between cell walls and bottoms, the bottom edges of the cell walls have hitherto been raised over the bottom at a distance in the order of 20 times the particle diameter. Surprisingly, it has proved possible to close this passage between the last cells without this giving rise to any problems, and whereby the efficiency of the apparatus has been increased with regard to the drying of materials with a large percentage of particles with long drying time.

Similarly as shown in FIGS. 4 and 5, one or more plate pieces 19 can be placed in the last cells, hereby to increase the retention time for the largest particles in the apparatus. Also as shown, these plate pieces 19 can be placed immediately over the bottom 5, and in such a manner that they extend from the outer wall of the vessel 1 in towards the middle of the apparatus, whereby a baffle effect is achieved opposite the flow of material which takes place through the openings 11.

I claim:

1. An apparatus for drying a particulate material in superheated steam comprising:

a closed vessel (1) configured as a body of rotation, said vessel (1) having a lower cylindrical part having a conical transition piece connected to an upper cylindrical part of larger diameter than the lower cylindrical part, said vessel (1) having a central part with a heat exchanger (3) having thereunder a transport element for steam in the form of a blower (6), the vessel having a number of upwardly open, elongated and substantially vertical processing cells (2) which are placed around the central part with the heat exchanger (3), a last (4) of these processing cells (2) having a closed bottom and being a discharge cell (4), the remaining cells (2) having a bottom (5) through which steam can permeate, the processing cells (2) which lie at the side of one another being open at a top opposite a common transfer zone (13), and at the bottom being in mutual connection through openings (11) at the lowermost ends of the cells, the particulate material introduced into the first of the processing cells (2) passing by the superheated steam, which is blown up through the steam-permeable bottoms (5), the particulate material being dried during its passage through the processing cells (2), the particulate material passing from one processing cell (2) to the next through said openings (11), said openings (11) between the discharge cell (4) and the processing cell or cells (2) having an arrangement (16, 17) for automatically regulating the amount of particulate material which passes through the openings (11), the arrangement (16, 17) being a regulation element (17) and means for closing the openings (11) which can be controlled depending on one or more measured parameters.

2. The apparatus according to claim 1, wherein the arrangement (16, 17) comprises a flap (16) responsive to the regulation element (17) for closing the opening (11) completely or partly.

3. The apparatus according to claim 1, wherein the closing of the openings (11) is controlled depending on a temperature which is measured in the last processing cell or cells (2) in the apparatus.

4. The apparatus according to claim 1, wherein substantially vertical plates (19) are inserted in the processing cell or cells (2) which lie adjacent to the discharge cell (4), said plates optionally extending from an outer wall of the vessel (1) towards a center of the vessel, and optionally from the steam-permeable bottom (5) or immediately above said bottom and upwards.

5. The apparatus according to claim 1, wherein the blower (6) is a centrifugal blower.

* * * * *